US005652091A

United States Patent [19]

Perry et al.

[11] Patent Number: 5,652,091

[45] Date of Patent: Jul. 29, 1997

[54] HEAT BLEACHABLE ELEMENTS HAVING POLYMERIC ACID LAYER ADJACENT HEAT BLEACHABLE ANTIHALATION LAYER

[75] Inventors: Robert James Perry, Pittsford; Ramanuj Goswami, Webster, both of N.Y.

[73] Assignee: Eastman Kodak Company, Rochester, N.Y.

[21] Appl. No.: 583,354

[22] Filed: Jan. 5, 1996

[51] Int. Cl.[6] ..... G03C 1/498

[52] U.S. Cl. ..... 430/617; 430/510; 430/517; 430/519; 430/523; 430/619

[58] Field of Search ..... 430/617, 350, 430/517, 339, 619, 519, 341, 343, 332, 510, 523, 529

[56] References Cited

U.S. PATENT DOCUMENTS

| | | | |
|---|---|---|---|
| 3,383,212 | 5/1968 | MacLachlan | 96/48 |
| 3,390,994 | 7/1968 | Cescon | 96/48 |
| 3,445,234 | 5/1969 | Cescon et al. | 96/90 |
| 3,533,797 | 10/1970 | James et al. | 96/90 |
| 3,615,481 | 10/1971 | Looney | 96/48 |
| 3,630,736 | 12/1971 | Cescon | 96/48 |
| 3,666,466 | 5/1972 | Strilko | 96/48 |
| 3,734,733 | 5/1973 | Poot et al. | 96/48 |
| 4,196,002 | 4/1980 | Levinson et al. | 430/617 |
| 4,201,590 | 5/1980 | Levinson et al. | 430/617 |
| 5,216,166 | 6/1993 | Burrows et al. | 546/165 |
| 5,258,274 | 11/1993 | Helland et al. | 430/522 |

*Primary Examiner*—Thorl Chea

*Attorney, Agent, or Firm*—J. Lanny Tucker

[57] ABSTRACT

Heat bleachable elements have antihalation layers composed of metallized or unmetallized formazan dyes, hexaarylbiimidzoles having alkoxy substituents and film forming binders that soften upon heating. These layers are rapidly bleached at relatively low temperatures. Polymeric acidic layers adjacent the antihalation layers provide an acidic component that increases bleaching rates when the acidic layer is also softened during processing.

24 Claims, No Drawings

HEAT BLEACHABLE ELEMENTS HAVING POLYMERIC ACID LAYER ADJACENT HEAT BLEACHABLE ANTIHALATION LAYER

CROSS REFERENCE TO RELATED APPLICATION

Reference is made to and priority claimed from U.S. Provisional application Ser. No. US 60/007,118, filed 31 Oct. 1995, entitled HEAT BLEACHABLE ELEMENTS HAVING POLYMERIC ACID LAYER ADJACENT HEAT BLEACHABLE ANTIHALATION LAYER.

FIELD OF THE INVENTION

This invention relates to colored, heat bleachable elements that undergo a change in electromagnetic absorption characteristics upon application of heat. These elements contain heat bleachable antihalation layers and polymeric layers adjacent the antihalation layers.

BACKGROUND OF THE INVENTION

A variety of photographic materials are known that can be processed by immersion in various processing solutions or baths. Such materials contain various layers and components, including antihalation or filter layers, overcoats and radiation sensitive layers.

The antihalation layer of an imaging element helps to prevent light that has passed through the radiation sensitive layer(s) from reflecting back into those layers. If reflection is not prevented, the resulting image is less sharp. In wet processes, the antihalation layer is generally removed or rendered colorless during processing.

Imaging elements are also known that can be processed, after imagewise exposure, simply by heating the element. These elements are often known as thermographic or photothermographic elements. It is generally desired that such elements include an antihalation or filter layer, especially to provide improved microimaging capability. In most cases, the antihalation layer must be rendered substantially transparent upon heat processing in order to avoid use of processing solutions.

A variety of antihalation compositions have been reported in the literature whereby the use of processing solutions is avoided. Such compositions generally include particular heat bleachable antihalation dyes, or incorporated addenda that act as bleaching agents.

For example, the use of radicals from biimidazoles in antihalation compositions is known, being described for example in U.S. Pat. No. 4,196,002 (Levinson et al) and U.S. Pat. No. 4,201,590 (Levinson et al). The heat developable compositions described therein become colorless upon exposure to heat for a given time.. The compositions contain formazan dyes used in reactive association with certain hexaarylbiimidazole compounds, which compounds are oxidative dimers of alkyl-substituted-arylimidazoles.

All of the known antihalation compositions suffer from one or more problems, including heat instability and requiring high heat processing or exhibiting only temporary bleaching. There is a continuing need for antihalation compositions that can be permanently and quickly bleached at lower temperatures.

Such compositions are described and claimed in copending and commonly assigned U.S. Ser. No. 08/583,395, having a filing date of Jan. 5, 1996, based on Provisional Application 60/008,156 filed on even date herewith by Perry, Goswami and Zielinski, and entitled HEAT BLEACHABLE ANTIHALATION COMPOSITION, ELEMENTS CONTAINING SAME AND METHOD OF USE. Such compositions include an acidic component in the antihalation composition.

While the invention described in the noted application has provided a significant advance in the art, there are instances when acids cannot be readily incorporated into the antihalation composition. Moreover, it would be desirable to have the flexibility to use acids outside of the antihalation composition that are prone to premature bleaching. Such acids must still be available to participate in the reactions that occur in the antihalation composition during heat processing.

SUMMARY OF THE INVENTION

The present invention provides additional advantages with a colored, heat bleachable element comprising a supported or self-supporting antihalation layer comprising an antihalation composition comprising:

(a) a formazan dye that absorbs at from about 500 to about 850 nm, (b) at least one hexaarylbiimidazole that consists essentially of an oxidative arylimidazole dimer of a compound represented by either structure Ia or Ib:

Ia

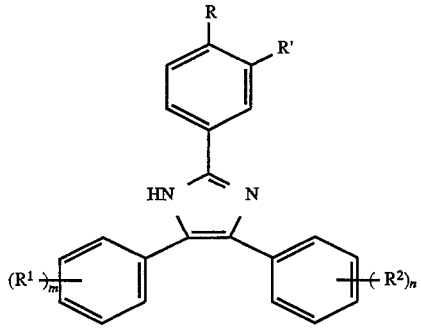

Ib

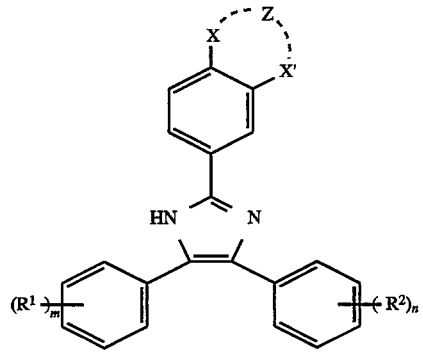

wherein R and R' are independently hydrogen, an alkyl group of 1 to 12 carbon atoms, an alkoxy group of 1 to 12 carbon atoms, amino, a cycloalkyl group having 5 to 7 carbon atoms in the ring, or an electron-rich heterocyclic group having 5 to 7 atoms in the ring, m and n are independently integers of 0 to 5, provided that at least one of R and R' is the alkoxy or amino group, X and X' are independently oxy or imino, Z is an alkylene group of 1 or 2 carbon atoms, and $R^1$ and $R^2$ are independently defined the same as R and R' except that neither $R^1$ nor $R^2$ is hydrogen, and (c) a film-forming, polar organic solvent soluble binder material having a glass transition temperature of from about 45° to about 150° C., the antihalation composition being bleachable when subjected to heating conditions of a temperature of from about 80° to about 150° C. for from about 1 to about 60 seconds, and the element further comprising, adjacent to the antihalation layer, an acid layer comprising at least one polymeric, film-forming carboxylic, sulfonic or phosphoric acid having a pKa of from about 0.5 to about 6 and a glass transition temperature of from about 45° to about 150° C.

The advantages of this invention include increased flexibility so that a wider variety of acidic materials can be used in the reactions occurring during heat processing. For example, polymeric sulfonic and phosphonic acids can be used as well as the polymeric carboxylic acids. The types and number of acids that can be incorporated into antihalation compositions is relatively limited, and some of those acids have been found to prematurely bleach. Thus, these problems and formulation constraints can be avoided by using the present invention. For instance, acids that may prematurely bleach in antihalation compositions may be used in polymeric form in the present invention without premature bleaching. Both the polymeric acid and antihalation layers used in this invention are softened during heat processing so the acid component of the polymeric acid layer can be in intimate association with the components of the antihalation layer in order to catalyze thermal bleaching of the antihalation composition. This property is achieved by using polymeric acids in the overcoat layer and polymeric binders in the antihalation composition that have specific glass transition temperatures.

DETAILED DESCRIPTION OF THE INVENTION

A critical component of the antihalation composition useful in this invention is at least one (one or more) hexaarylbiimidazole that consists essentially of an oxidative arylimidazole dimer of the compound represented by either structure Ia or Ib:

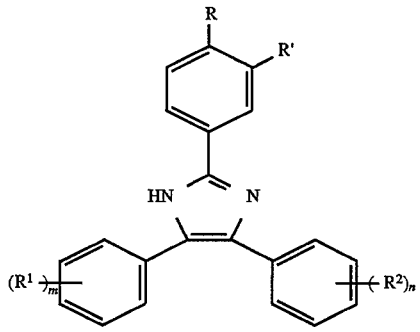

Ia

-continued

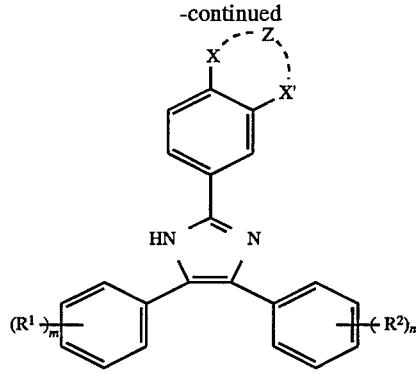

Ib wherein R and R' are independently hydrogen, a substituted or unsubstituted alkyl group of 1 to 12 carbon atoms (such as substituted or unsubstituted methyl, ethyl, n-propyl, isopropyl, i-butyl, t-butyl, hexyl, dodecyl, benzyl or neopentyl), a substituted or unsubstituted alkoxy group of 1 to 12 carbon atoms (such as substituted or unsubstituted methoxy, ethoxy, 1-propoxy, benzyloxy, ethyleneoxy or dodoxy), amino (primary, secondary or tertiary having one or more alkyl groups as defined above), a substituted or unsubstituted cycloalkyl of 5 to 7 carbon atoms in the ring (such as substituted or unsubstituted cyclopentyl, cyclohexyl or cycloheptyl), or an electron-rich substituted or unsubstituted heterocyclic group having 5 to 7 atoms (carbon, oxygen, sulfur and nitrogen) in the central ring (such as substituted or unsubstituted furanyl, thiophenyl, pyridyl or pyrrolyl). Other heterocyclic rings would be readily apparent to a skilled artison.

$R^1$ and $R^2$ are independently defined the same as for R and R' except that neither $R^1$ nor $R^2$ is hydrogen. Preferably, $R^1$ and $R^2$ are independently a substituted or unsubstituted alkyl group of 1 to 4 carbon atoms or a substituted or unsubstituted alkoxy Group of 1 to 4 carbon atoms.

When the compounds have an $R^1$ or $R^2$ substituent, it can be at any position on the respective phenyl rings. Preferably, the one or more $R^1$ or $R^2$ groups are in the ortho or para positions of the phenyl rings, in relation to the carbon atoms attached to the imidazole ring. Preferably, when one of $R^1$ or $R^2$ is present, it is in the para or 4-position.

In Structure Ia, it is essential that at least one of R and R' is an alkoxy or amino group as defined above. Preferably, at least one is an alkoxy group (substituted or unsubstituted) of 1 to 8 carbon atoms, and more preferably, R is an alkoxy Group (substituted or unsubstituted) of 1 to 6 carbon atoms. Most preferably, R is an alkoxy group (substituted or unsubstituted) of 1 to 4 carbon atoms.

In Structure Ib, X and X' are independently oxy or amino $$\text{-NR''-}.$$

Thus, each or both of X and X' can be the same or different divalent group. Preferably, at least one of them is oxy, and more preferably, each of X and X' is oxy. Z is alkylene of 1 or 2 carbon atoms, and can be substituted. Preferably, Z is methylene. R" can be a substituted or unsubstituted alkyl group of 1 to 12 carbon atoms (as defined above for R, R', $R^1$ and $R^2$), or a substituted or unsubstituted aryl group of 6 to 10 carbon atoms in the ring (such as phenyl, naphthyl, xylyl, p-methoxyphenyl or p-chlorophenyl).

Moreover, in structures Ia and Ib, m and n are independently integers of 0 to 5, and preferably, m and n are each 0 or 1. Most preferably, each of m and n is 0.

A particularly useful hexaarylbiimidazole is:

R-1

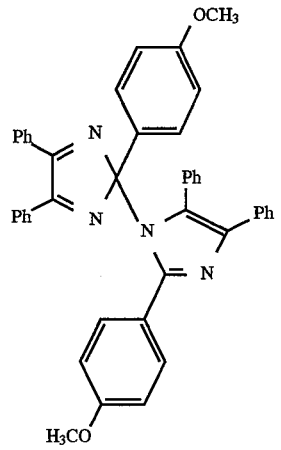

wherein "Ph" is phenyl

Other useful hexaarylbiimidazoles are described in U.S. Pat. No. 3,383,212 (MacLachlan), U.S. Pat. No. 3,390,994 (Cescon), U.S. Pat. No. 3,445,234 (Cescon et al), U.S. Pat. No. 3,533,797 (James et al), U.S. Pat. No. 3,615,481 (Looney), U.S. Pat. No. 3,630,736 (Cescon et al), U.S. Pat. No. 3,666,466 (Strilko et al) and U.S. Pat. No. 3,734,733 (Poot et al), as long as they fall within either of structures Ia and Ib. Other useful compounds are described in the following Table I, in reference to structures Ia and Ib.

TABLE I

| R | R' | $R^1$# |
|---|---|---|
| methoxy* | methoxy | H |
| methoxy | methoxy | H |
| ** | ** | H |
| methoxy | H | H |
| n-butoxy | H | H |
| H | methoxy | H |
| H | benzoxy | H |
| n-butoxy | H | methoxy |
| methoxy | H | methyl |
| methoxy | H | H |
| n-butoxy | H | methyl |

*Also contained methoxy in 3-position of phenyl ring carrying R and R'.
**Compound of structure Ib wherein X and X' were both oxy, and Z was methylene.
#Substituents at para position of phenyl ring.

If desired, a combination of two or more hexaarylbiimidazoles of the noted structure can be used. These materials can be readily prepared using known preparatory methods, described for example in the noted Levinson et al patents and the other references cited above. For example, one preparation is described by Hayoshi, *Bull. Chem. Soc.* Japan, 33, 565(1960).

Important teaching relating to hexaarylbiimidazoles has been published by Aldag, *Photochromism, Molecules and Systems,* Durr and Bourns-Laurent (Eds.), Chapter 18, pages 714–717, Elsevier, 1990. A single triarylimidazole can conceivably give rise to different structural dimers if the dimer linkage is made via C-N, C-C or N-N bonds. These individual structural dimers or mixtures thereof can be generated chemically, thermally or photolytically from a common triarylimidazoyl radical. While the dimers specifically described herein are linked via a C-N bond (2-carbon atom of one imidazole and nitrogen atom of the other imidazole), the present invention is not so limited.

The formazan dyes useful in the present invention absorb at from about 400 to about 850 nm. Preferably, formazan dyes absorbing at from about 500 to about 850 nm are used. Useful formazan dyes are well known in the art, including the Levinson et al patents cited above, both of which are incorporated herein by reference. The formazan dyes can be metallized or unmetallized.

More particularly, useful formazan dyes can be represented by structure II:

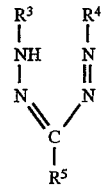

wherein $R^3$ is a substituted or unsubstituted aromatic group of 6 to 20 atoms in the ring system, such as carbocyclic or heterocyclic aromatic rings. Preferably, $R^3$ is a substituted or unsubstituted coordinating aromatic group having 5 to 15 atoms in the ring system. Such aromatic groups can be carbocyclic or heterocyclic containing one or more nitrogen, oxygen or sulfur atoms. By "coordinating" is meant that the aromatic group is capable of providing a pair of electrons that can be shared with the metal ion nucleus when the formazan dye is complexed with a metal ion (described below). The aromatic group can be substituted with one or more groups as defined below.

$R^4$ can also be an aryl group (substituted or unsubstituted) having from 6 to 14 carbon atoms in the ring nucleus (such as phenyl, tolyl, xylyl, naphthyl, anthryl, p-nitrophenyl, benzthiophenyl, benzimidazoyl or pyridyl).

$R^5$ is an alkyl group (substituted or unsubstituted) of 1 to 20 carbon atoms (such as substituted or unsubstituted methyl, ethyl, n-propyl, isopropyl, t-butyl, hexyl, decyl, benzyl and other branched or linear hydrocarbons readily apparent to one skilled in the art), an aryl group (substituted or unsubstituted) of 6 to 14 carbon atoms in the ring (such as phenyl, xylyl, tolyl, naphthyl, 4-hydroxyphenyl, p-nitrophenyl, dimethoxyphenyl, anthroquinonyl and other substituted carbocyclic aromatic ring systems readily apparent to one skilled in the art), or a substituted or unsubstituted 5- to 7-membered heterocyclic group having 5 to 7 atoms in the ring nucleus, such as pyridyl, pyrimidyl, oxazyl, benzothiazolyl, benzimidazolyl, and others readily apparent to one skilled in the art.

Particularly useful formazan dyes (some in metallized form) include, but are not limited to:

F-1

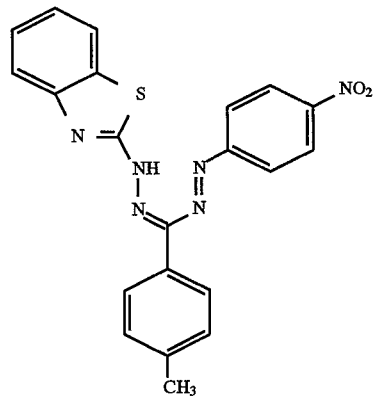

-continued
F-2
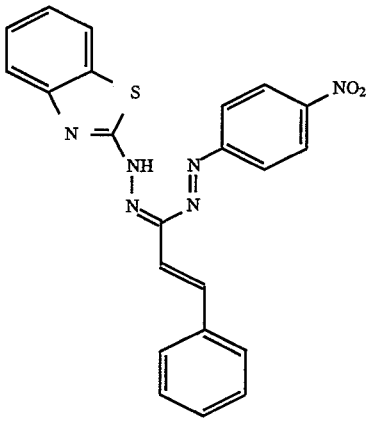
F-3
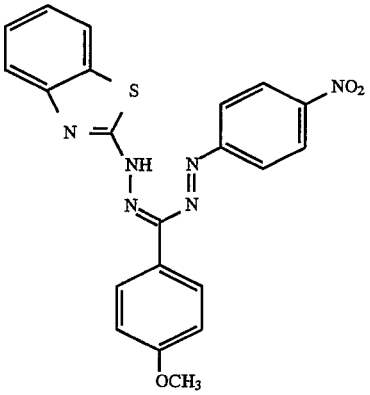
F-4
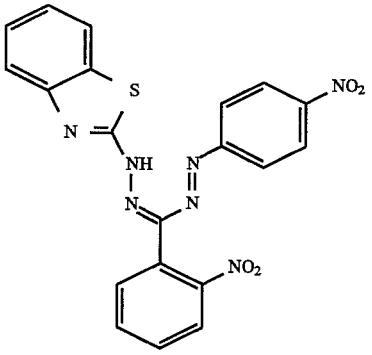
F-5
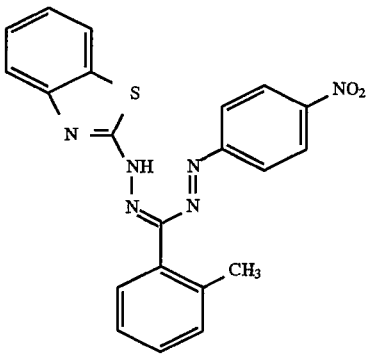
-continued
F-6
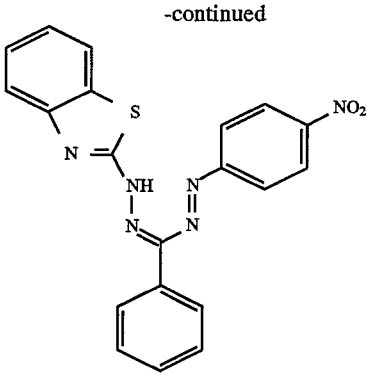
F-7
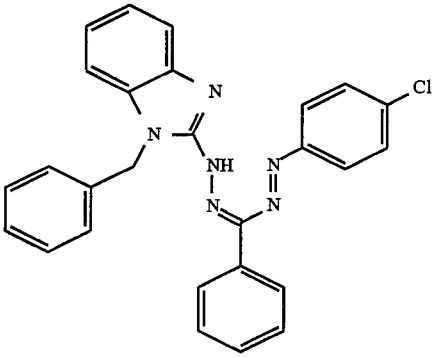
F-8
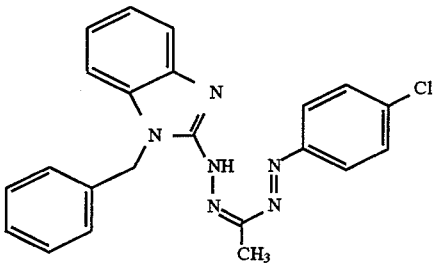
F-9
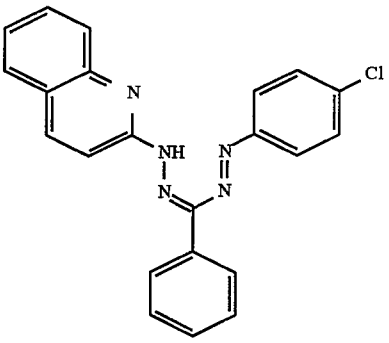
F-10
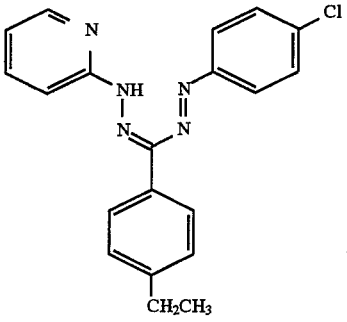

-continued

F-11

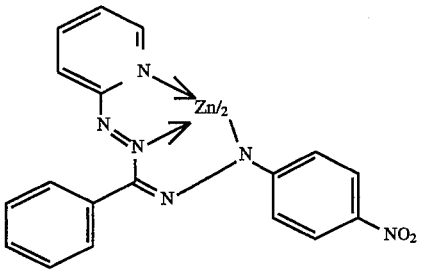

F-12

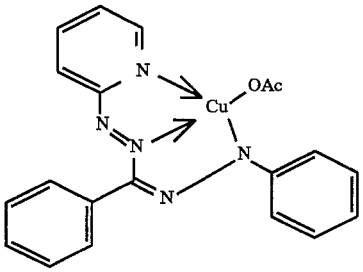

F-13

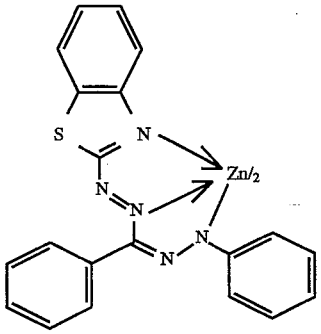

F-14

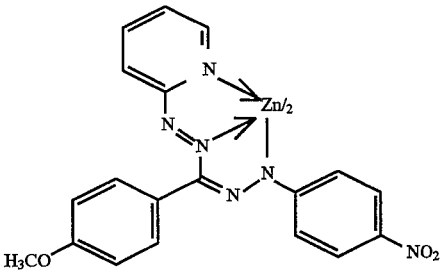

F-15

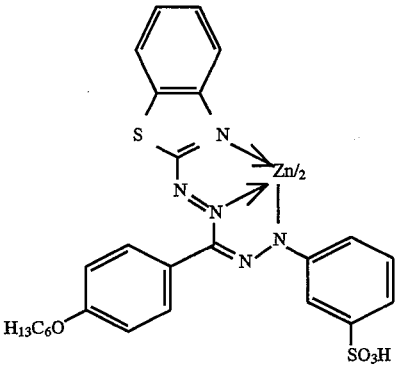

-continued

F-16

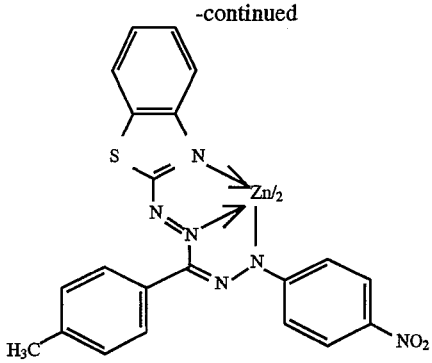

A preferred formazan is F-3 wherein $R^3$ is p-nitrophenyl, $R^4$ is benzthiazole, and $R^5$ is p-methoxyphenyl.

The preparation of formazan dyes is well known in the art, for example, as described by Nineham, *Chem. Reviews,* 55, pp. 355–475(1955).

While the formazan dyes can be used in unmetallized form, preferably, they are used in a metallized complex meaning that they are complexed with one or more suitable metal ions, including but not limited to, cobalt, zinc, cadmium, copper and others readily apparent to one skilled in the art. In general, the metal and formazan dye must be chosen such that the binding constant ($K_b$) with the dye is less than or equal to $10^{25}$. In other words, $\log(K_b)$ must be $\leqq 25$. Preferably, $\log(K_b) \leqq 21$. Zinc is the preferred metal to use with the formazan dyes listed above, and especially with dye F-3. Binding constants are described by Uchiumi et al in *Anal. Sci.,* 7, 119–124(1991).

Methods of making the metallized formazan dyes are well known in the art even if the exact mechanism of complex formation is not fully understood. The metal complexes can be mono- or multidentate. For example, a formazan dye can be mixed with a suitable metal salt (such as an acetate, sulfate or chloride) in a suitable solvent to allow complexation to occur. The resulting metallized complex can be isolated from the reaction mixture and then mixed with the hexaarylbiimidazole as described herein. Alternatively and preferably, the metallized formazan dye complex is formed in situ with the hexaarylbiimidazole, and used directly from the reaction mixture. This embodiment is described below in Examples 22–24. Further details are provided in copending and commonly assigned U.S. Ser. No. 08/583,395 filed , Jan. 5, 1996 and based on Provisional Application 60/006,981 filed on even date herewith by Perry, Goswami and Zielinski, and entitled "METHOD OF PREPARING HEAT BLEACHABLE ANTIHALATION COMPOSITIONS AND COMPOSITIONS PREPARED THEREFROM."

A mixture of unmetallized or metallized formazan dyes can be used in this invention if desired, in any suitable proportion. Alternatively, mixtures of unmetallized formazan dyes, or mixtures of metallized formazan dyes, can be used.

The optimum combination of metallized or unmetallized formazan dye and hexaarylbiimidazole compounds will depend upon such factors as the particular antihalation or filter dyes to be used, processing conditions, desired degree of bleaching in the layer containing the formazan dye, solubility characteristics of the components and other factors readily apparent to one skilled in the art. Such optimization would be routine experimentation to a skilled artisan.

The proportions of metallized or unmetallized formazan dye and hexaarylbiimidazole can be readily adjusted over a wide range by a skilled artisan depending upon the location of use in an element, particular filter dyes used, desired degree of absorption, processing temperature and other factors. Thus, in some applications, the concentration of dye is sufficient if it provides an optical density of at least about 0.05, while in other applications, such as in antihalation layers of photothermographic elements, the optical density should be at least about 0.2, with from about 0.3 to about 0.8 being preferred.

The amount of formazan dye used in the compositions is generally from about 1 to about 200 mg/10 g of solution. More preferably, the amount is from about 5 to about 100 mg/10 g of solution and more preferably, from about 5 to about 50 mg/10 g of solution. When metallized formazan dyes are used, the amount of metal is generally from about 0.05:1 to about 1:1 molar ratio to formazan dye.

Generally, the molar ratio of hexaarylbiimidazole to the formazan dye is from about 1:1 to about 5:1. More preferably, this molar ratio is from about 2:1 to about 3:1.

It is desired that at least 50% (preferably at least 70% and more preferably at least 90%) of the composition of this invention be bleached (changed from colored to colorless) when subjected to a temperature of from about 80° to about 150° C. for from about 1 to about 60 seconds. Preferably, bleaching occurs at a temperature of from about 100 to about 150° C. for up to about 30 seconds and more preferably, bleaching occurs at a temperature of from about 110° to about 140° C. for from about 1 to about 15 seconds. It is most desired to completely bleach the composition within about 5 seconds at about 120° C. As one would understand, the lower the bleaching temperature, the longer it takes for the desired bleaching to occur.

Another component of the antihalation composition useful in this invention is one or more film-forming, organic solvent soluble binder materials. Such materials are generally transparent or translucent as films, and do not adversely affect the reaction occurring during bleaching of the metallized or unmetallized formazan dye. Moreover, the binder materials must be able to withstand the conditions of heating necessary for bleaching and be compatible with the formazan dye and hexaarylbiimidazole. By compatible is meant that the binder material must not adversely affect these components or the desired heat bleachability. These materials are soluble in one or more organic solvents including but not limited to, lower alcohols (such as methanol, ethanol, isopropanol and isobutanol), ketones (such as acetone, methyl ethyl ketone, methyl isobutylketone and ethyl acetate), chlorinated solvents (such as methylene chloride, trichloromethane and tetrachloroethylene), N,N-dimethylformamide, tetrahydrofuran, dimethyl sulfoxide, toluene, acetonitrile and mixtures of any of these. While the useful binder materials may not be soluble in every organic solvent, each one is soluble in at least one of such solvents. Acetone and a mixture of acetone and methyl isobutylketone are preferred. The mixture is most preferred.

Also required is that the binder materials have a composite (cumulative) glass transition temperature of from about 45° to about 150° C. (preferably from about 50° to about 120° C.) so that when the element is heat processed, the binder material will soften sufficiently for acid component in the overcoat layer (described below) to be in intimate contact with the reactive components of the antihalation layer. By "intimate contact" is meant that the acidic component can participate in the required reactions that occur in the antihalation composition during heat processing. As is described below, the acidic polymeric also has a suitable glass transition temperature for it to soften during heat processing. A given glass transition temperature desired for a given antihalation composition will depend upon the processing conditions desired. Glass transition temperature is readily determined using procedures known in the art, described for example, by Turi, Thermal Characterization of Polymeric Materials, Academic Press, New York, 1981.

Particularly useful binder materials include, but are not limited to, a polystyrene (as well as polymers of derivatives of styrene), polyacrylates and polymethacrylates [such as poly(methyl methacrylate), poly(butyl methacrylate) poly (2-hydroxyethyl)methacrylate, poly(hexyl methacrylate) poly(ethyl methacrylate)], polycarbonates, cellulose esters (such as cellulose acetate butyrate, carboxylated cellulose, cellulose acetate propionate and copolymers thereof), polysulfonamides [such as poly(ethylene-co-1,4-cyclohexylenedimethylene-1-methyl-2,4-benzene disulfonamide)], polyacetals [such as poly(vinyl butyral) and poly(vinyl formal)], polyvinyl acetate, maleic anhydride ester copolymers, polymers of vinylidene or vinyl halides [such as poly(vinylidene chloride) or poly(vinyl chloride)] and acrylonitrile-vinylidene chloride copolymers, ethylene-vinyl acetate copolymers, butadiene-styrene copolymers, and polyesters, as long as they have the required glass transition temperature. The preferred binder material is poly(vinyl butyral) which can be obtained commercially as BUTVAR B-76 from Monsanto Company.

The antihalation composition of this invention, or other materials of the elements, can also include other optional addenda commonly employed in such layers including, but not limited to, sensitizing dyes, stabilizers (or stabilizer precursors), development activators, brighteners, antifoggants, hardeners, plasticizers, lubricants, coating aids, melt formers and anti-fading agents. Melt formers, such as N-methylbenzamide, dibutylphthalate, N,N-diethyllauramide and tricresylphosphate are particularly useful in the antihalation composition in an amount of from about 0.5 to about 20 weight % (based on total binder weight).

The antihalation composition of this invention can be used as an antihalation component in a variety of photothermographic or thermographic elements. Useful elements include those designed to provide an image from photographic silver halide, such as color images, or elements designed for non-silver imaging. Photographic elements that are designed for microimaging are especially useful with the compositions of this invention.

The antihalation composition can be in any suitable location in such elements. It is necessary that the metallized or unmetallized formazan dye and the hexaarylbiimidazole compound be in "reactive association" with each other to provide the desired heat bleachability according to this invention. The term "in reactive association" is intended to mean that the described materials are in a location with respect to each other that enables the desired processing and heat bleaching. That is, the term is intended to mean that the hexaarylbiimidazole compound and the metallized or unmetallized formazan dye are in location with respect to one another which enables the desired change in dye color to colorless upon heating for the time specified herein. In this invention, they are generally in the same layer of the element.

The element of this invention also comprises, adjacent to the antihalation layer, an acid layer comprising at least one polymeric, film-forming carboxylic, sulfonic or phosphoric acid having a pKa of from about 0.5 to about 6 (preferably from about 2 to about 5). Mixtures of polymeric, film-forming carboxylic, sulfonic or phosphoric acids can be used if desired. The one or more polymeric materials are acidic is nature (having a net negative charge) and thus having one or more negative charges along the polymeric backbone. The materials also have a cumulative glass transition temperature of from about 45° to about 150° C., and preferably of from about 50° to about 120° C.. The glass transition temperature is measured as described above for the antihalation binder materials. The glass transition temperature of the polymeric acid can be the same or different as that for the binder material used in the antihalation composition. The glass transition temperature in the noted range assures that the polymeric acid will soften sufficiently during heat processing to allow it to be in intimate contact with the antihalation layer reactive components, as described above.

Representative polymeric, film-forming carboxylic, sulfonic and phosphoric acids include, but are not limited to, polymers (both homo- and copolymers) of acrylic acid, methacrylic acid, maleic acid, styrene sulfonic acid, methyl methacrylic acid, hexanedioic acid monoethenyl ester, ethanammonium N-(carboxymethyl)-N,N-dimethyl-2-[(2-methyl-1-oxo-2-propenyl)oxy]chloride, styrene carboxylic acid, and others readily apparent to one skilled in the art. Such polymers include poly(acrylic acid), poly(methacrylic acid), poly(styrene carboxylic acid), poly(styrene phosphoric acid), poly{ethanammonium N-(carboxymethyl)-N,N-dimethyl-2-[(2-methyl-1-oxo-2-propenyl)oxy]chloride}, poly(styrene sulfonic acid), poly(methyl methacrylic acid), poly(methyl vinyl ether-co-maleic acid), poly(methyl methacrylate-co-methacrylic acid), poly(styrene-co-styrenesulfonic acid), and others known in the considerable literature relating to acidic polymeric, film forming materials. Some useful polymeric acids are described by Molyneux, Water-Soluble Synthetic Polymers: properties and Behavior, Vol. II, CRC Press, Inc., Boca Raton, Fla., 1985, pages 8–62. A preferred polymeric acid is polyacrylic acid.

The polymeric acid layer is formulated by dissolving the one or more polymers in a suitable solvent (for example, water or aqueous mixtures with water-miscible solvents, such as alcohols), and applied to the element so it is adjacent the antihalation layer. Optional addenda in this layer include plasticizers, hardeners and surfactants or coating aids, as long as they do not adversely affect the required properties of the layer (for example, glass transition temperature).

The polymeric acid can be applied to a supported or self-supporting antihalation layer, or the antihalation can be applied to the polymeric acid layer. In either embodiment, the resulting layers in the element can have sufficient strength as to be self-supporting, but more likely they are disposed on a suitable support (defined below) also having thereon a photothermographic layer containing a photosensitive component which can be a silver halide emulsion or silver behenate dispersion or a non-silver photosensitive component. When a silver photosensitive component is used, silver halide is especially useful (such as silver chloride, silver iodide, silver bromide, silver bromoiodide, silver chlorobromide and silver chlorobromoiodide). Further details of such materials are known in the art, including the Levinson et al patents, noted above.

A variety of non-silver photosensitive components can also be used, if desired, comprising colored, heat bleachable compositions. These can be, for example, photosensitive diazo imaging materials, imaging materials based on photoreductants, photosensitive dyes and others readily apparent to one skilled in the art. These materials are also well known in the art, including the Levinson et al patents noted above.

It is useful in some elements to have an overcoat layer on the element of this invention. The overcoat can be over the photothermographic layer or antihalation layer, or both. The overcoat layer can be composed of one or more of the binder materials described above. In preferred embodiments, the overcoat layer is the polymeric acid layer described herein.

Thus, in one embodiment, the antihalation layer is on the support opposite the photothermographic layer, and the polymeric acid layer is coated over the antihalation layer. In a similar embodiment, the polymeric acid layer is between the antihalation layer and the support. In still another embodiment, the three layers are on the same side of the support with the polymeric acid layer being between the two other layers.

The elements of this invention can comprise a variety of supports that can tolerate the processing conditions. Typical supports include, but are not limited to, cellulose ester films (such as cellulose triacetate), poly(vinyl acetate), polyesters (such as polyethylene terephthalate or polyethylene naphthalate), polycarbonates, cellulose nitrate, glass, metals, and others readily apparent to one skilled in the art. A flexible and transparent film support is preferred. The supports can be subbed or unsubbed.

The antihalation composition of this invention can be part of the support, that is it can be present in a transparent support material. Alternatively, the antihalation composition is coated onto a support material using any of the conventional coating techniques and equipment.

A variety of imagewise exposure means are useful for exposure of an element of this invention. Typically, the element is exposed to a visible light source to provide a developable image, but other sources of electromagnetic radiation are also useful. Heat processing of the element can be accomplished with any suitable heating means including a hot plate, microwave oven, infrared heater, heated roller or block. Processing is generally under ambient conditions of pressure and humidity.

The element of this invention can be used to provide a negative or positive image, depending for example, on the selection of the photosensitive component.

As used herein, the term "about" is used to define various parameters. In defining pKa, it refers to a variance of ±0.5 of the indicated value. In defining molar ratios and amounts, and other parameters, it refers to a variance of ±20% of the indicated value. In defining temperatures, it refers to a variance of ±5° C. of the indicated temperature.

The following examples are presented to illustrate the practice of this invention, but are not meant to limit it in any way. All percentages are by weight unless otherwise indicated.

EXAMPLES 1–4

Preparation of Heat Bleachable Elements with Acid Overcoats

Several heat bleachable elements of this invention were prepared with polymeric acid overcoat layers, and compared with similar elements prepared without overcoat layers.

Each element contained an antihalation layer prepared by mixing hexaarylbiimidazole R-1 (identified above, 2 equivalents) and zinc metallized complexes of several formazan dyes (identified below, 10 mg) in poly(vinyl butyral) (10 g, 6% in acetone, BUTVAR B-76 polymer). These antihalation solutions were coated onto poly(ethylene terephthalate) supports at a wet thickness of 0.013 cm, and dried at 54°–63° C. for 2–3 minutes.

Strips of the resulting elements were cut and processed as noted below in Table II on heated blocks. Densities ($D_{max}$)

were measured as total transmittance densities at the $\lambda_{max}$ for the coating using an uncoated poly(ethylene terephthalate) strip as the reference sample.

Control elements A-D, outside the scope of this invention, were prepared without an overcoat layer. Examples 1–4 of this invention were prepared by additionally coating an aqueous formulation of poly(acrylic acid) (6.25%) over the antihalation layer, and dried. The elements were cut and processed just like the Control elements.

Table II below shows the results of the processing of the elements. The presence of the acid overcoat layer in the element decreased the processing temperature necessary to achieve substantial bleaching. Also, 90% bleaching was observed for Example 3 at 160° C. in comparison with only 50% bleaching at the same temperature.

TABLE II

| | | | $D_{max}$ at $\lambda_{max}$ (% bleaching) | | | |
|---|---|---|---|---|---|---|
| Element | Dye | Acid Overcoat | Unprocessed | 5 sec/ 120° C. | 5 sec/ 140° C. | 5 sec/ 160° C. |
| Control A | F-14 | No | 0.27 | — | 0.20(26) | 0.11(59) |
| Control B | F-15 | No | 0.13 | — | 0.11(15) | 0.11(15) |
| Control C | F-11 | No | 0.54 | — | 0.43(20) | 0.27(50) |
| Control D | F-13 | No | 0.41 | — | — | 0.32(22) |
| Example 1 | F-14 | Yes | 0.27 | 0.17(37) | 0.04(85) | 0.04(85) |
| Example 2 | F-15 | Yes | 0.11 | 0.10(9) | 0.07(36) | 0.05(60) |
| Example 3 | F-11 | Yes | 0.54 | 0.44(19) | 0.17(69) | 0.05(91) |
| Example 4 | F-14 | Yes | 0.39 | — | 0.23(41) | 0.16(59) |

EXAMPLES 5–10

Use of Poly(methacrylic acid) In Overcoat Layer

Additional elements of this invention were prepared as described in Examples 1–4 except that the acid overcoat layer formulation contained poly(methacrylic acid) (8% in water).

The elements were processed and evaluated as described in Examples 1–4. It is apparent from the data provided in Table III that the acid overcoat layer provided enhanced bleaching rates as compared to the elements without the acid overcoat layer.

TABLE III

| | | | $D_{max}$ at $\lambda_{max}$ (% bleaching) | | | | |
|---|---|---|---|---|---|---|---|
| Element | Dye | Acid Overcoat | Unprocessed | 5 sec/ 120° C. | 15 sec 120° C. | 5 sec/ 140° C. | 5 sec/ 160° C. |
| Control E | F-14 | No | 0.27 | — | — | 0.20(26)* | 0.11(59)* |
| Control F | F-15 | No | 0.13 | — | — | 0.11(15)* | 0.11(15)* |
| Control G | F-11 | No | 0.50 | — | 0.47(6) | 0.40(20)* | 0.27(46)* |
| Control H | F-13 | No | 0.35 | — | 0.35(0) | 0.33(6) | 0.31(11) |
| Control I | F-12 | No | 0.22 | 0.24(0) | — | 0.20(9) | 0.12(45) |
| Example 5 | F-14 | Yes | 0.31 | 0.17(45) | 0.05(84) | 0.02(94) | — |
| Example 6 | F-15 | Yes | 0.07 | 0.07(0) | 0.06(14) | 0.05(28) | — |
| Example 7 | F-11 | Yes | 0.53 | 0.37(30) | 0.18(66) | 0.08(85) | 0.04(92) |
| Example 8 | F-13 | Yes | 0.40 | 0.34(15) | 0.27(33) | 0.13(68) | 0.08(80) |
| Example 9 | F-12 | Yes | 0.21 | 0.19(10) | 0.16(24) | 0.10(48) | 0.04(81) |
| Example 10 | F-16 | Yes | 0.35 | 0.12(66) | 0.05(86) | 0.01(97) | — |

*Processed for 15 seconds.

EXAMPLES 11–13

Use of Various Acid Overcoat Materials

Several elements of this invention were prepared like those in Example 3 except other polymeric acids were used in the acid overcoat layers. The polymeric acids were coated out of aqueous formulations (6.25%). The results of heat processing are shown in Table IV below. The Control C results are also shown for comparison.

TABLE IV

| | | $D_{max}$ at $\lambda_{max}$ (% bleaching) | | | | |
|---|---|---|---|---|---|---|
| Composition | Polymeric Acid | Un-processed | 5 sec/ 120° C. | 15 sec/ 120° C. | 5 sec/ 140° C. | 5 sec/ 160° C. |
| Control C | None | 0.54 | — | — | 0.43(20)* | 0.27(50)* |
| Example 11 | Poly(methyl vinylether-co-maleic acid) | 0.5 | 0.45(18) | 0.38(24) | 0.15(70) | 0.10(80) |
| Example 12 | Poly(styrene-co-benzene sulfonic acid) | 0.54 | 0.49(9) | — | 0.38(30) | 0.20(63) |
| Example 13 | Poly(methyl methacrylate-co-methacrylic acid) | 0.53 | 0.32(36) | 0.21(60) | 0.11(79) | 0.06(89) |

*Processed for 15 seconds.

It should be noted that in Example 12, the polymeric acid layer was prepared from an acidic polymer having benzene sulfonic acid moieties. This acidic layer was successfully used in a heat processable element. However, we have observed that when a similar non-polymeric acid, p-toluenesulfonic acid, is incorporated into the antihalation composition itself, and the polymeric acid was omitted, the antihalation composition prematurely bleached (that is, became colorless without heat processing).

EXAMPLES 14–21

Effect of Melt Former in Antihalation Layer of Elements

Several elements of this invention were prepared, with and without N-methylbenzamide (100 mg) as a melt former in the antihalation formulation. The rest of the elements were prepared as described in Examples 1–4. The acid overcoat layer was formulated using an aqueous solution of poly(acrylic acid) (6.25%). Table V below shows the processing results. The presence of the melt former enhanced bleaching.

TABLE V

| | | | $D_{max}$ at $\lambda_{max}$ (% bleaching) | | | | |
|---|---|---|---|---|---|---|---|
| Element | Dye | Melt Former | Unprocessed | 5 sec/ 120° C. | 15 sec/ 120° C. | 5 sec/ 140° C. | 5 sec/ 160° C. |
| Example 14 | F-14 | No | 0.30 | 0.22(27) | 0.17(43) | 0.05(83) | 0.04(87) |
| Example 15 | F-15 | No | 0.06 | 0.06(0) | — | — | 0.05(18) |
| Example 16 | F-11 | No | 0.49 | 0.47(4) | — | 0.23(53) | 0.11(78) |
| Example 17 | F-13 | No | 0.38 | 0.36(5) | — | 0.28(26) | 0.14(63) |
| Example 18 | F-14 | Yes | 0.30 | 0.13(57) | 0.05(83) | 0.03(90) | — |
| Example 19 | F-15 | Yes | 0.06 | 0.05(18) | — | — | 0.03(50) |
| Example 20 | F-11 | Yes | 0.51 | 0.38(25) | 0.25(51) | 0.12(76) | 0.09(82)* |
| Example 21 | F-13 | Yes | 0.40 | 0.26(35) | 0.19(52) | 0.12(70) | 0.07(83) |

*Processed for 15 seconds.

EXAMPLES 22–24

Preparation and Use of Antihalation Compositions In Situ with Acid Overcoats

An alternative and preferred method for preparing the antihalation compositions of this invention is to mix metal ion, formazan dye and hexaarylbiimidazole together so that the metallized dye complex is formed within the reaction mixture and used therein without isolation. This procedure is described in more detail in copending and commonly assigned U.S. Ser. No. 08/583,392, filed on Jan. 5, 1996, and based on Provisional Application 60/006,981 filed on even date herewith by Perry, Goswami and Zielinski identified above. This method is contrasted with a formulation in which the metallized formazan dye complex is preformed and then mixed with the hexaarylbiimidazole.

Table VI below shows the results of bleaching of antihalation compositions formulated from zinc acetate (various amounts), formazan dye F-14 (10 mg), hexaarylbiimidazole R-1 (2 equivalents), in poly(vinyl butyral) binder (10 g) in acetone (6%). Elements of the invention comprised polmeric acid overcoats formulated with an aqueous solution of poly(acrylic acid) (6.25%). The Control elements had no overcoat layer.

An antihalation composition was prepared by mixing a complex of zinc and formazan dye F-3 (10 mg), hexaarylbiimidazole R-1 (30 mg), and poly(vinyl butyral) (10 g, 8%) in 80:20 methyl isobutylketone/acetone solvent mixture. It was coated on a poly(ethylene terephthalate) support and dried. A polymeric acid overcoat layer, formulated from 8% poly(methacrylic acid) in water was then applied to the antihalation layer, and dried.

On the opposite side of the support, a photosensitive layer and an overcoat layer were coated.

The photosensitive layer was formulated from a silver behenate dispersion (37.53 g Ag/1, 6.2% BUTVAR B-76 polymer binder in methyl isobutylketone), silver bromide emulsion (40.91 g Ag/1, 13.2% BUTVAR B-76 polymer binder in methyl isobutylketone), succinimide (10%, 10.5% BUTVARB-76 polymer binder in acetone), dimethylsiloxane surfactant (10% in methyl isobutylketone), monobromo (* shown below, 2.5%, 10.5% BUTVAR B-76 polymer binder in acetone), triazine (* shown below, 2.5%, 10.5% BUTVARB-76 in methyl isobutylketone), dye (* shown below, 0.2% in methanol), sulfonamidophenol (10%, 10.5% BUTVAR B-76 polymer binder in methyl isobutylketone), palmitic acid (10%, 10.5% BUTVAR B-76 polymer binder in acetone), and BUTVAR B-76 poly(vinyl butyral) polymer binder (10.5%) in methyl isobutylketone. The photosensitive composition was coated on the support and dried using conventional techniques.

TABLE VI

| | Metal Salt | $D_{max}$ at $\lambda_{max}$ (% bleaching) | | | | |
|---|---|---|---|---|---|---|
| Composition | Equivalents | Unprocessed | 5 sec/120° C. | 15 sec/120° C. | 5 sec/140° C. | 5 sec/160° C. |
| Control J | 0.5 | 0.34 | 0.33(3) | — | 0.28(18) | 0.21(38) |
| Control K | 1.0 | 0.39 | 0.26(33) | — | 0.16(59) | 0.11(72) |
| Control L | 2.0 | 0.36 | 0.24(33) | 0.18(50) | 0.11(69) | 0.05(86) |
| Example 22 | 0.5 | 0.37 | 0.15(59) | 0.10(73) | 0.04(89) | — |
| Example 23 | 1.0 | 0.38 | 0.11(71) | 0.05(87) | 0.02(95) | — |
| Example 24 | 2.0 | 0.37 | 0.11(70) | 0.04(89) | 0.02(95) | — |

EXAMPLE 25

Photothermographic Element

A photothermographic element of this invention was prepared and heat processed as follows.

*monobromo

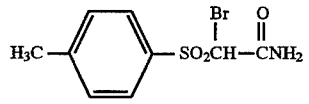

*triazine

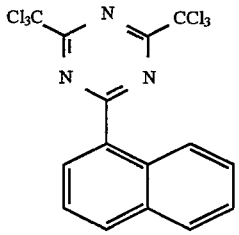

-continued

*dye

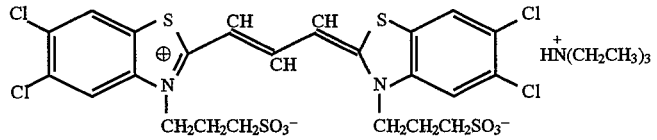

The overcoat layer was formulated from poly(vinyl alcohol) (6.4% in water), Olin 10G surfactant (10% in water), p-toluenesulfonic acid (1 normal in water), methanol and tetraethylorthosilicate, and water. It was similarly coated and dried.

The resulting element was imagewise exposed using a commercial EG & G sensitometer for $10^{-3}$ seconds, and then heat processed at 119° C. for 5 seconds to provide sharp step-tablet images in the element. Little residual color from the formazan dye in the antihalation layer was observed.

EXAMPLE 26

Use of Unmetallized Formazan Dye

An antihalation composition containing an unmetallized formazan dye complex was prepared as follows, and incorporated into an element. The antihalation composition contained formazan dye F-3 (20 mg), hexaarylbiimidazole R-1 (62 mg) and 8% poly(vinyl butyral) (10 g), formulated in 80:20 methyl isobutylketone/acetone solvent mixture. It was coated on a poly(ethylene terephthalate) support and dried.

A polymeric acid layer composition containing 6% poly (acrylic acid) in water was also formulated as described above, and coated as a layer adjacent the antihalation layer, and dried.

A separate element (Control M) was similarly prepared except that the polymeric acid layer overcoat was omitted.

Samples of the elements were processed as described above in Example 25 at 119° C. for 5 seconds. The results are listed below in Table VII. While the presence of a polymeric acid overcoat is not necessarily required for rapid bleaching of unmetallized formazan dyes, the presence of the overcoat does not adversely affect the bleaching process.

TABLE VII

| Element | Polymeric Overcoat? | $D_{max}$ at $\lambda_{max}$ (% bleaching) Unprocessed | 5 sec/119° C. |
|---|---|---|---|
| Control M | No | 0.18 | 0.02(89) |
| Example 26 | Yes | 0.16 | 0.02(88) |

The invention has been described in detail with particular reference to preferred embodiments thereof, but it will be understood that variations and modifications can be effected within the spirit and scope of the invention.

We claim:

1. A colored, heat bleachable element comprising a supported or self-supporting antihalation layer comprising an antihalation composition comprising:

(a) a formazan dye that absorbs at from 400 to 850 run, (b) at least one hexaarylbiimidazole that consists essentially of an oxidative arylimidazole dimer of a compound represented by either structure Ia or Ib:

Ia

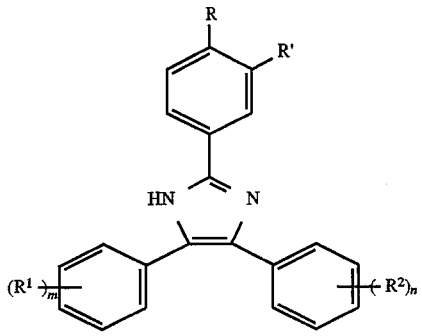

Ib

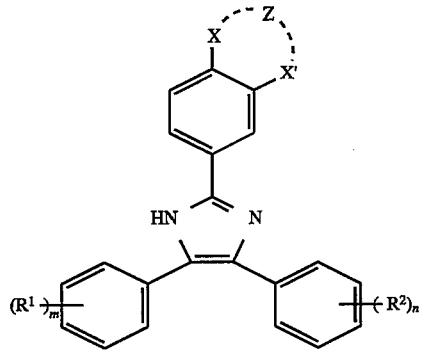

wherein R and R' are independently hydrogen, an alkyl group of 1 to 12 carbon atoms, an alkoxy group of 1 to 12 carbon atoms, amino, a cycloalkyl group having 5 to 7 carbon atoms in the ring, or an electron-rich heterocyclic group having 5 to 7 atoms in the ring, m and n are independently integers of 0 to 5, provided that at least one of R and R' is said alkoxy or amino group, X and X' are independently oxy or imino, Z is alkylene of 1 to 2 carbon atoms, and $R^1$ and $R^2$ are independently defined the same as R and R' except that neither $R^1$ nor $R^2$ is hydrogen, and (c) a film-forming, polar organic solvent soluble binder material having a glass transition temperature of from about 45° to about 150° C., said antihalation composition being bleachable when subjected to heating conditions of a temperature of from about 80° to about 150° C. for from 1 to 60 seconds, and said element further comprising, adjacent to said antihalation layer, an acid layer comprising at least one polymeric film-forming carboxylic, sulfonic or phosphoric acid having a pKa of from 0.5 to 6and a glass transition temperature of from 45° to 150° C..

2. The element of claim 1 wherein the molar ratio of said hexaarylbiimidazole to said formazan dye is from 1:1 to 5:1.

3. The element of claim 1 wherein said formazan dye is present in a metallized formazan dye complex comprising said dye and a metal that has a log(K) with said dye of ≦25.

4. The element of claim 1 wherein said formazan dye has the structure II:

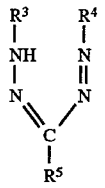

wherein $R^3$ is an aromatic group of 6 to 20 carbon atoms in the ring, $R^4$ is an aryl group having 6 to 14 carbon atoms in the ring system, and $R^5$ is an alkyl group of 1 to 20 carbon atoms, an aryl group of 6 to 14 carbon atoms in the ring system or a heterocyclic ring having 5 to 7 atoms in the ring.

5. The element of claim 4 wherein $R^3$ is a coordinating aromatic group having 5 to 15 atoms in the ring system.

6. The element of claim 3 wherein said metal in said complex is cobalt, zinc, cadmium or copper.

7. The element of claim 5 wherein R is alkoxy of 1 to 6 carbon atoms.

8. The element of claim 1 wherein $R^1$ and $R^2$ are independently an alkyl group of 1 to 4 carbon atoms or an alkoxy group of 1 to 4 carbon atoms, m and n are each 0 or 1, at least one of X and X' is oxy, and Z is methylene.

9. The element of claim 1 wherein said binder material has a glass transition temperature of from 50° to 120° C.

10. The element of claim 8 wherein said binder material is a polystyrene, polyacrylate or polymethacrylate, polysulfonamide, polyvinyl or polyvinylidene halide, polycarbonate, cellulose ester, polyvinyl acetate, maleic anhydride ester copolymer, polyvinyl acetate, acrylonitrile-vinylidene chloride copolymer, polyacetal, an ethylene-vinyl acetate copolymer, butadiene-styrene copolymer or a polyester.

11. The element of claim 1 wherein said heating conditions are a temperature of from 100° to 150° C. for a time of up to 30 seconds.

12. The element of claim 1 wherein said complex metal is zinc, R is alkoxy of 1 to 4 carbon atoms, R' is hydrogen, m and n are each 0, $R^3$ is p-nitrophenyl, $R^4$ is benzthiazole, and $R^5$ is p-methoxyphenyl, and said binder material is poly (vinyl butyral).

13. The element of claim 1 wherein said polymeric acid in said acid layer has a glass transition temperature of from 50° to 120° C.

14. The element of claim 1 wherein said polymeric acid is a homopolymer or copolymer prepared from acrylic acid, methacrylic acid, maleic acid, styrene sulfonic acid, methyl methacrylic acid, styrene carboxylic acid, hexanedioic acid monoethenyl ester, or ethaneammonium N-(carboxymethyl)-N,N-dimethyl-2-[(2-methyl-1-oxo-2-propenyl)oxy] chloride.

15. The element of claim 1 further comprising a melt former in said antihalation composition.

16. The element of claim 14 wherein said melt former is present in an amount of from 0.5 to 20 weight % based on total binder material weight.

17. The element of claim 16 wherein said antihalation layer is opposite said photothermographic layer, and said acid layer is an overcoat thereof.

18. The element of claim 16 wherein said antihalation layer is opposite said photothermographic layer, and said acid layer is between said antihalation layer and said support.

19. The element of claim 16 wherein said antihalation layer is on the same side as said photothermographic layer and said acid layer is between said antihalation layer and said support.

20. The element of claim 16 wherein said photothermographic layer is a silver halide or silver behenate imaging layer.

21. The element of claim 16 wherein said formazan dye is present in a metallized formazan dye complex comprising said formazan and a metal that has a log(K) with said dye of ≦25.

22. The element of claim 20 wherein the metal in said complex is zinc.

23. A photothermographic element comprising a support having thereon a photothermographic layer, and further comprising on said support, an antihalation layer comprising an antihalation composition comprising:

(a) a formazan dye that absorbs at from 500 to 850 nm, (b) at least one hexaarylbiimidazole that Consists essentially of an oxidative arylimidazole dimer of a compound represented by either structure Ia or Ib:

Ia

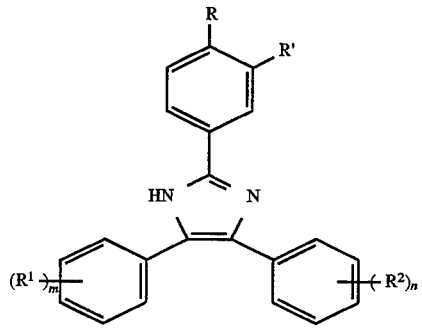

Ib

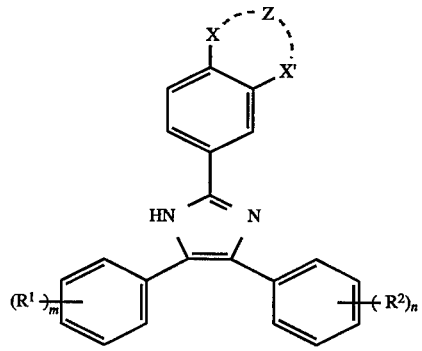

wherein R and R' are independently hydrogen, an alkyl group of 1 to 12 carbon atoms, an alkoxy group of 1 to 12 carbon atoms, amino, a cycloalkyl group having 5 to 7 carbon atoms in the ring, or an electron-rich heterocyclic group having 5 to 7 atoms in the ring, m and n are independently integers of 0 to 5, provided that at least one of R and R' is said alkoxy or amino group, X and X' are independently oxy or imino, Z is alkylene of 1 to 2 carbon atoms, and $R^1$ and $R^2$ are independently defined the same as R and R' except that neither $R^1$ nor $R^2$ is hydrogen, and (c) a film-forming, organic solvent soluble binder material having a glass transition temperature of from 45° to 150° C., said composition being bleachable when subjected to heating conditions of a temperature of from 80° to 150° C. for from 1 to about 60 seconds, said element further comprising, adjacent to said antihalation layer, an acid layer comprising at least one polymeric, film-forming carboxylic, sulfonic or phosphoric acid having a pKa of from 0.5 to 6 and a glass transition temperature of from 45° to 150° C.

24. A colored, heat bleachable element comprising a supported or self-supporting antihalation layer comprising an antihalation composition comprising:

(a) a formazan dye that absorbs at from 400 to 850 nm, (b) at least one hexaarylbiimidazole that consists essentially of an oxidative arylimidazole dimer of a compound represented by either structure Ia or Ib:

Ia

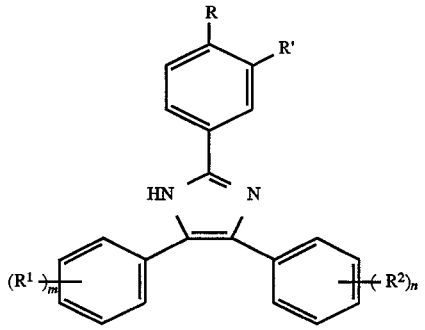

-continued

Ib

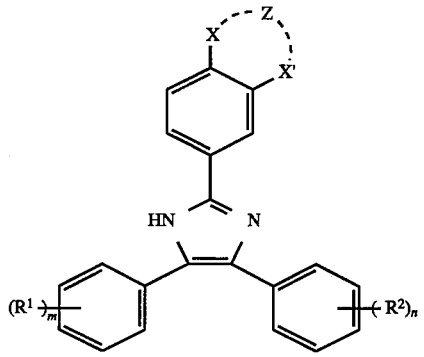

wherein R and R' are independently hydrogen, an alkyl group of 1 to 12 carbon atoms, an alkoxy group of 1 to 12 carbon atoms, amino, a cycloalkyl group having 5 to 7 carbon atoms in the ring, or an electron-rich heterocyclic group having 5 to 7 atoms in the ring, m and n are independently integers of 0 to 5, provided that at least one of R and R' is said alkoxy or amino group, X and X' are independently oxy or imino, Z is alkylene of 1 to 2 carbon atoms, and $R^1$ and $R^2$ are independently defined the same as R and R' except that neither $R^1$ nor $R^2$ is hydrogen, and (c) a film-forming, polar organic solvent soluble binder material having a glass transition temperature of from about 45° to about 150° C., said antihalation composition being bleachable when subjected to heating conditions of a temperature of from 80° to 150° C. for from 1 to 60 seconds, and said element further comprising, adjacent to said antihalation layer, an acid layer comprising at least one polymeric film-forming carboxylic, sulfonic or phosphoric acid having a pKa of from about 0.5 to about 6 and a glass transition temperature of from 45° to 150° C., and wherein said acid layer is an outer overcoat layer.

* * * * *